US008707464B2

(12) United States Patent
Trenhaile

(10) Patent No.: US 8,707,464 B2
(45) **Date of Patent: *Apr. 29, 2014**

(54) SURGICAL GARMENT

(71) Applicant: Rockford Orthopaedic Sports Medicine Services, LLC, Belvidere, IL (US)

(72) Inventor: Scott Trenhaile, Belvidere, IL (US)

(73) Assignee: Rockford Orthopaedic Sports Medicine Services, LLC, Belvidere, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/858,475

(22) Filed: Apr. 8, 2013

(65) Prior Publication Data

US 2013/0225044 A1 Aug. 29, 2013

Related U.S. Application Data

(63) Continuation of application No. 12/608,437, filed on Oct. 29, 2009, now Pat. No. 8,414,352.

(60) Provisional application No. 61/109,246, filed on Oct. 29, 2008.

(51) Int. Cl.
*A41D 13/00* (2006.01)

(52) U.S. Cl.
USPC ..... 2/69; 2/114

(58) Field of Classification Search
USPC ..... 2/105, 106, 113–115, 125, 126, 69, 85, 2/93, 80, 95
See application file for complete search history.

(56) References Cited

U.S. PATENT DOCUMENTS

| | | | | | |
|---|---|---|---|---|---|
| 1,155,544 | A | * | 10/1915 | Bonoff | 2/48 |
| 1,637,518 | A | * | 8/1927 | Brunk et al. | 2/74 |
| 2,807,804 | A | * | 10/1957 | Miller | 2/126 |
| 2,880,731 | A | * | 4/1959 | Edythe | 450/30 |
| 3,024,466 | A | * | 3/1962 | Agostini | 2/48 |
| 3,064,265 | A | | 11/1962 | Bridgewaters | |
| 3,378,853 | A | * | 4/1968 | Fierst | 2/90 |
| 3,380,075 | A | * | 4/1968 | Marthinsson | 2/126 |
| 3,826,266 | A | | 7/1974 | Alpert | |
| 4,006,495 | A | * | 2/1977 | Jones | 2/93 |
| 4,187,855 | A | | 2/1980 | Paulus et al. | |
| 4,261,059 | A | * | 4/1981 | Spitz | 2/108 |
| 4,347,629 | A | * | 9/1982 | Itoi | 2/108 |
| 4,369,792 | A | | 1/1983 | Miller | |
| 4,571,743 | A | * | 2/1986 | Wagoner | 2/88 |
| 4,804,351 | A | | 2/1989 | Raml et al. | |
| 4,977,622 | A | * | 12/1990 | Schley | 2/59 |
| 5,023,953 | A | * | 6/1991 | Bettcher | 2/126 |

(Continued)

*Primary Examiner* — Gloria Hale

(74) *Attorney, Agent, or Firm* — Dicke, Billig & Czaja, PLLC

(57) ABSTRACT

A surgical garment includes an undergarment and an outer garment configured to be worn over the undergarment. The undergarment includes a brassiere including a front panel, a back panel, a shoulder strap extending from a top portion of a first side of the front panel to a top portion of a first side of the back panel, a width of elastic material extending along a bottom of the front and back panels, and a releasable fastening system releasably coupling a side portion of the first side of the front panel with a side portion of the first side of the back panel. The outer garment includes a torso portion and removable shoulder portions extending from the torso portion.

15 Claims, 5 Drawing Sheets

(56) References Cited

U.S. PATENT DOCUMENTS

| | | | | |
|---|---|---|---|---|
| 5,066,302 | A | | 11/1991 | Rice |
| 5,088,116 | A | * | 2/1992 | Gould ..... 2/82 |
| 5,088,117 | A | * | 2/1992 | Fulmer ..... 2/114 |
| 5,097,537 | A | | 3/1992 | Ewing |
| 5,158,541 | A | | 10/1992 | McCurley |
| 5,180,326 | A | | 1/1993 | Williams |
| 5,182,812 | A | | 2/1993 | Goldsby |
| 5,782,670 | A | | 7/1998 | Whisman |
| 5,797,786 | A | | 8/1998 | Smith et al. |
| 5,798,062 | A | | 8/1998 | Thielbar |
| 5,820,444 | A | | 10/1998 | McGaughey |
| 5,824,075 | A | | 10/1998 | Thielbar |
| 5,862,527 | A | | 1/1999 | Trevino |
| 6,390,885 | B1 | | 5/2002 | Brooks |
| 6,402,586 | B1 | | 6/2002 | Winik et al. |
| 6,550,067 | B2 | | 4/2003 | Force |
| 6,786,798 | B1 | | 9/2004 | Gendel |
| 6,983,489 | B2 | | 1/2006 | Caprio |
| 7,086,163 | B1 | | 8/2006 | Makotinsky |
| 7,238,081 | B2 | | 7/2007 | Fildan et al. |
| 7,275,977 | B1 | | 10/2007 | Rhodes |
| 8,075,366 | B1 | | 12/2011 | Jaksic et al. |
| 8,128,455 | B2 | | 3/2012 | La Fontaine |
| 2010/0017935 | A1 | | 1/2010 | La Fontaine |

* cited by examiner

SURGICAL GARMENT

CROSS REFERENCE TO RELATED APPLICATIONS

This application is a Continuation of U.S. patent application Ser. No. 12/608,437 filed on Oct. 29, 2009, and incorporated herein by reference, which claims priority under 35 U.S.C. §119(e) to U.S. Provisional Patent Application Ser. No. 61/109,246 filed on Oct. 29, 2008, and incorporated herein by reference.

FIELD OF THE INVENTION

The present invention relates generally to a surgical garment that allows surgeons to perform shoulder surgery on female patients without exposing their breasts throughout the pre-surgical, surgical, and post-surgical process. More specifically, the surgical garment provides a two-piece system including an outer garment and an undergarment both donned pre-operatively, wherein the outer garment may be removed after surgery and the undergarment may remain on during the post-operative period.

BACKGROUND OF THE INVENTION

Shoulder surgery may be a painful and traumatic procedure for many individuals. When undergoing shoulder surgery, the patient typically is placed in a gown made of paper or reusable cotton. While in a holding area before surgery, the surgical sight may be marked on the patient by the operative surgeon, thus requiring the shoulder skin to be exposed. The patient is then transported to the operating room to establish anesthesia. Once the patient is asleep, the gown is partially or fully removed to allow exposure of the operative shoulder for prep and drape. Thereafter, the surgery is performed, followed by application of a sterile dressing and a cooling device (e.g., ice pad), and placement of the shoulder in a sling or shoulder immobilizer.

After surgery, the patient typically has their gown draped over the operative shoulder. Unfortunately, the gown does not fit well over the cooling device and the sling or immobilizer. As such, the patient's chest wall is often times exposed during this time because of the ill fitting gown and the cooling device and the sling or immobilizer.

Unfortunately, the breast of the patient on the side of the operative shoulder is often times exposed to surgical staff before, during, and after surgery, and exposed to family and friends that are assisting the patient in their time of need following surgery. As such, women particularly feel vulnerable during shoulder surgery by having to expose their breasts, thus adding further anxiety to the overall procedure.

For these and other reasons, there is a need for the present invention.

DETAILED DESCRIPTION

A desirable surgical garment system would allow a patient to don a supportive undergarment 20 that may remain on the patient before, during, and after shoulder surgery. Before surgery, a second, outer garment 30 may be placed over the undergarment and act as a gown that may remain on the patient throughout the procedure to keep the patient covered.

Undergarment

Figure 1:
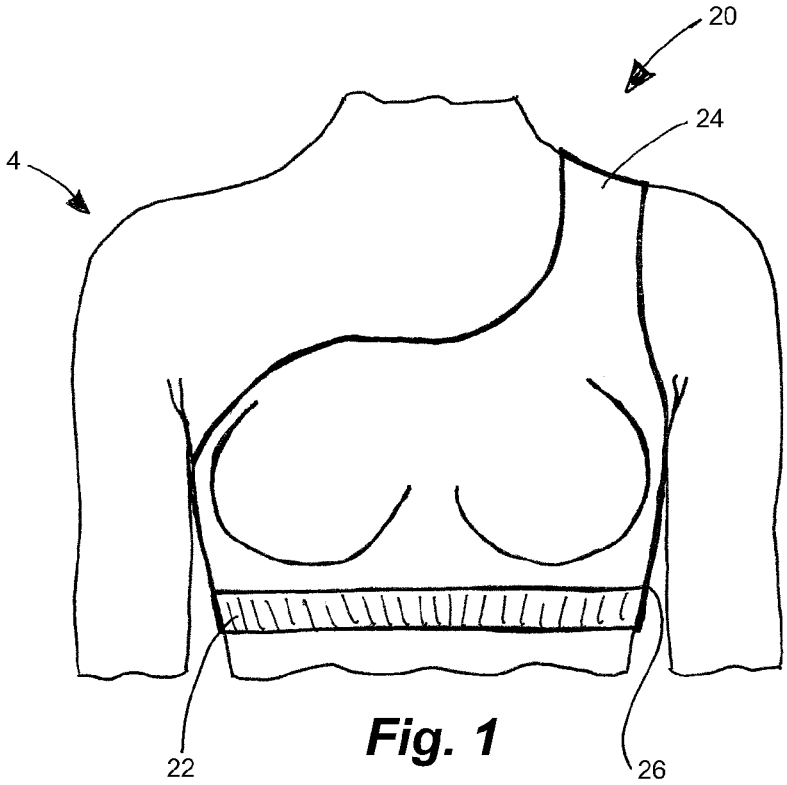
FIG. 1 is a frontal view illustrating one example of an undergarment of a surgical garment system.
Figure 2:
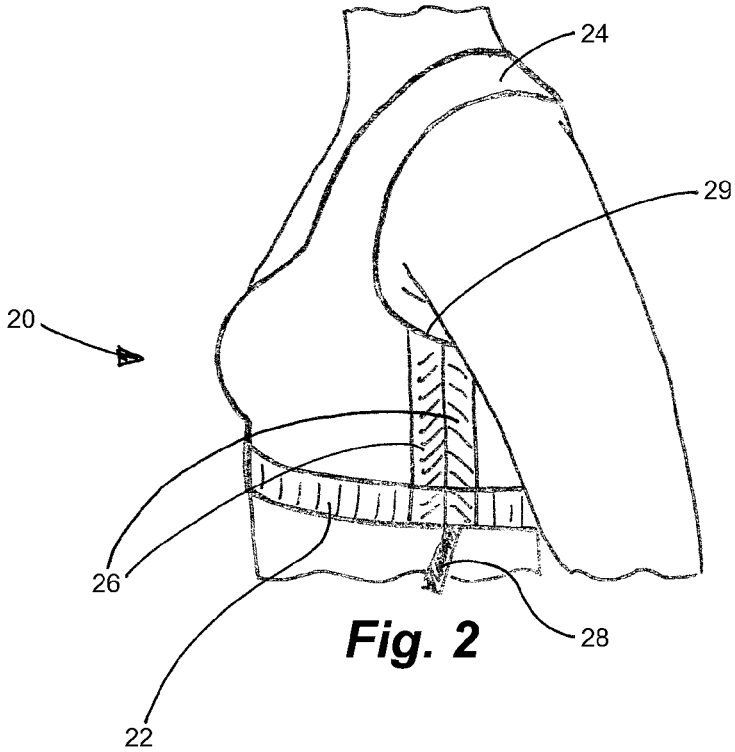
FIG. 2 is a left side view of the undergarment of FIG. 1.
Figure 3:
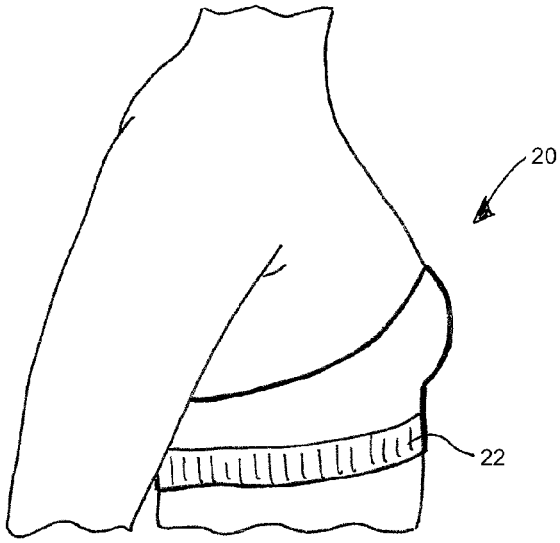
FIG. 3 is a right side view of the undergarment of FIG. 1.

The undergarment 20 comprises a surgical brassiere (FIGS. 1, 2, 3). In one example, the surgical brassiere is a latex-free product that is nonflammable and made of a material that is elastic in nature and easy to launder. In one example, the surgical brassiere is reversible to allow it to be used on the left shoulder or the right shoulder.

In one example, the surgical brassiere rides low on the torso and includes a wide elastic band 22 along the bottom for added support (FIGS. 1, 2, 3). In one example, the surgical brassiere includes a shoulder strap 24 to be positioned on the non-operative side of the patient (FIGS. 1, 2). In one example, the shoulder strap 24 is sufficiently wide and extends over the top of the non-operative shoulder for distribution of load.

In one example, the surgical brassiere is free of a shoulder strap on the operative side of the patient (FIGS. 1, 3). More specifically, no strap extends over the top of the shoulder on the operative side. In one example, the surgical brassiere is low cut near the breast on the operative side, such that the low cut and the lack of a shoulder strap on the operative side allow the operative shoulder 4 to be prepped and draped into a sterile field without having to remove the surgical brassiere throughout the surgical and post-surgical processes. In addition, the lack of a shoulder strap on the operative side eliminates any pressure which may result from a shoulder strap near any operative incisions.

In one example, the surgical brassiere includes a releasable fastening system to be positioned on the non-operative side of the patient in the axilla area (FIG. 2). The releasable fastening system allows for easy, one-handed removal using the non-operative shoulder. In one example, the releasable fastening system includes overlapping flaps fitted with cooperative hook-and-loop fasteners (e.g., Velcro) 26. In one example, an additional rip cord 28 is provided to facilitate releasing of the overlapping flaps (i.e., pulling apart of the Velcro) and removal of the surgical brassiere.

In use, the surgical brassiere is donned by the patient on the day of the shoulder surgery. For example, the patient would remove all torso clothing and put on the surgical brassiere with the operative shoulder 4 exposed (FIG. 1).

Outer Garment

Figure 9:
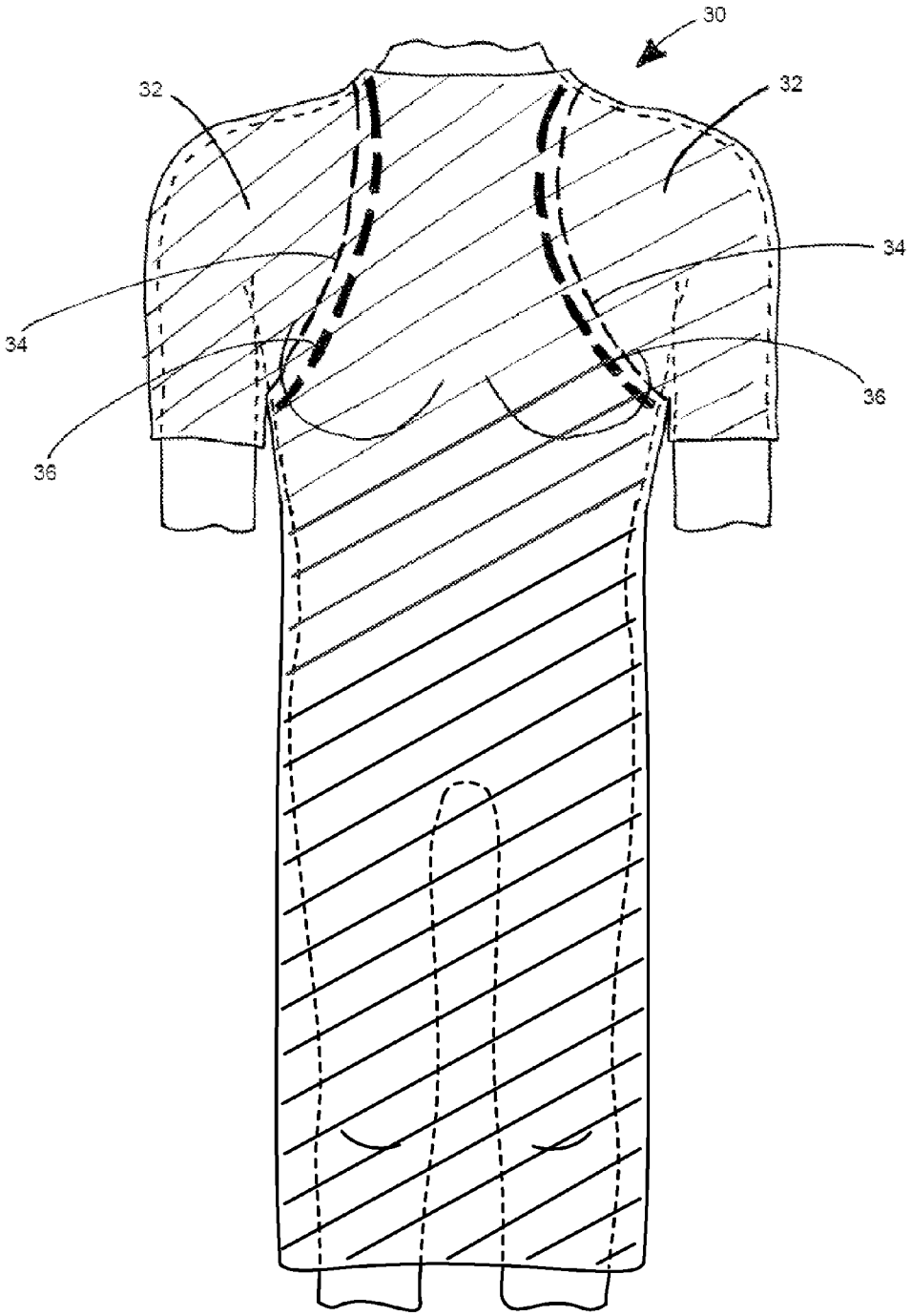
FIG. 9 is a frontal view illustrating one example of an outer garment of a surgical garment system including a removable shoulder portion.

The outer garment 30 comprises an operative gown (FIGS. 4, 5, 6, 7, 9). In one example, the operative gown is made of water repellent paper and covers the patient's body from the neck to below the knees (FIG. 9). In one example, the operative gown is worn by the patient during the time spent at the surgical center with the operative gown being removed prior to the patient going home after surgery.

Figure 4:
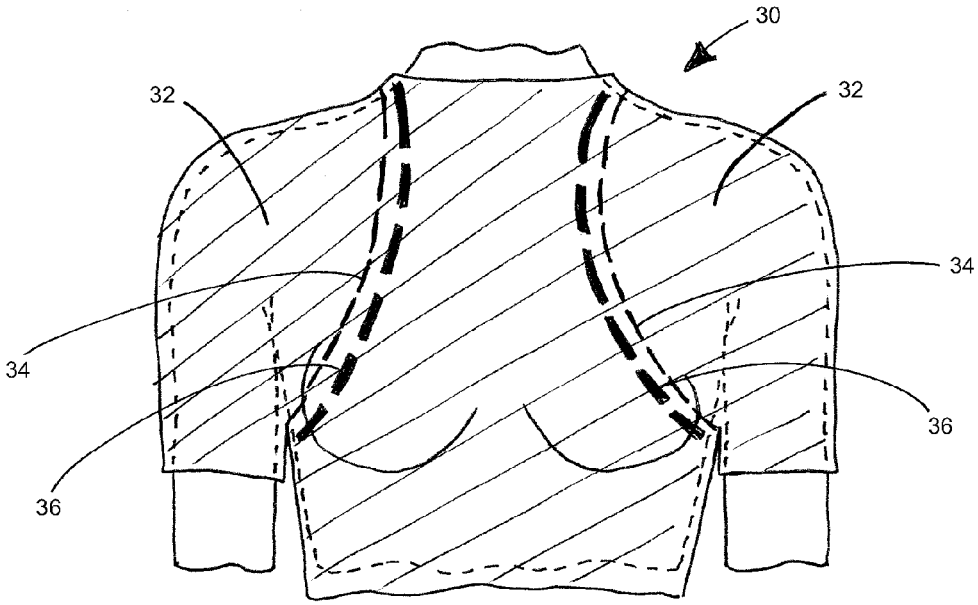
FIG. 4 is a frontal view illustrating one example of an outer garment of a surgical garment system including a removable shoulder portion.
Figure 5:
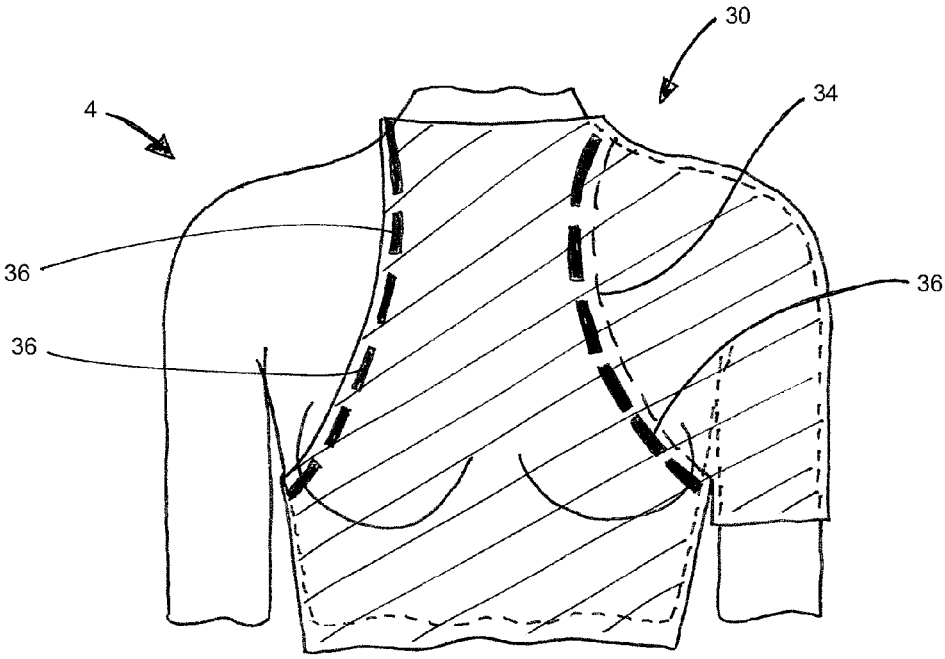
FIG. 5 is a frontal view of the outer garment of FIG. 4 illustrating one example of removal of the removable shoulder portion.
Figure 6:
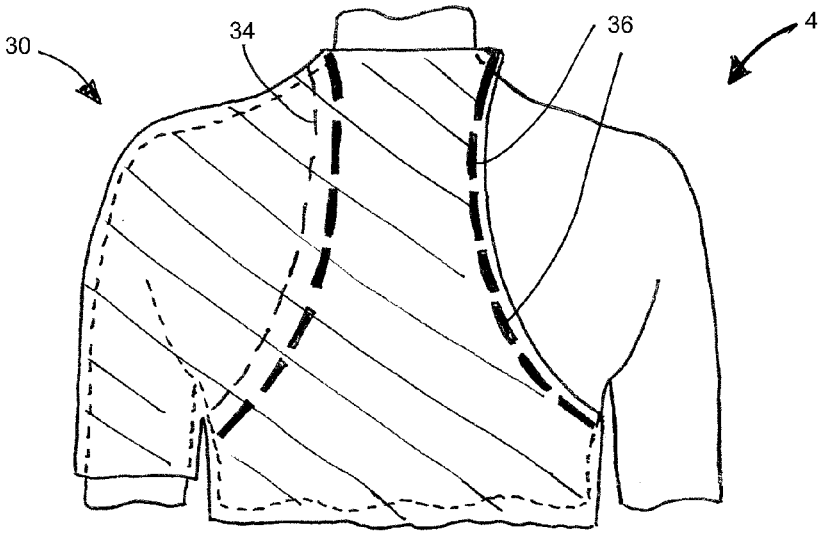
FIG. 6 is a back view of the outer garment of FIG. 4 illustrating one example of removal of the removable shoulder portion.
Figure 7:
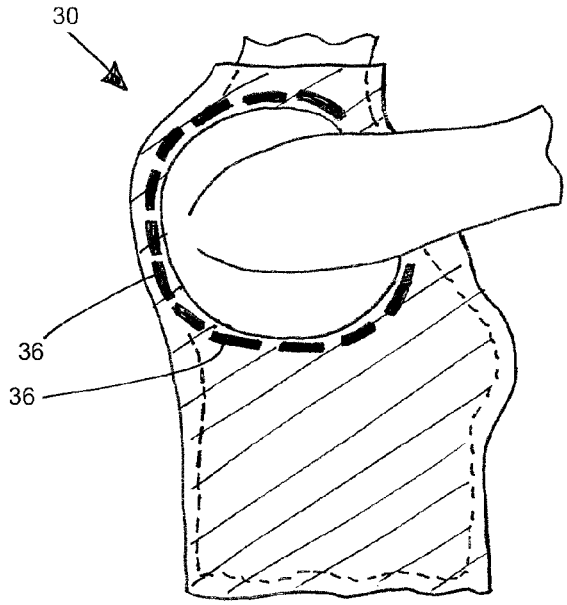
FIG. 7 is a right side view of the outer garment of FIG. 4 illustrating one example of removal of the removable shoulder portion.

In one example, the operative gown includes removable shoulder portions or sleeves 32 so that either the left shoulder portion or sleeve or right shoulder portion or sleeve can be removed to expose the skin on the operative shoulder side (FIGS. 5, 6, 7). In one example, the removable shoulder portions or sleeves 32 are delineated by perforations 34 for each shoulder portion or sleeve 32 such that each respective removable shoulder portion or sleeve 32 is removed by tearing along the perforations 34 (FIG. 4).

In one example, the operative gown includes releasable adhesive tabs (i.e., sticky tabs) 36 provided adjacent the perforations 34 medially of the removable shoulder portions or sleeves 32 (FIG. 4). The releasable adhesive tabs 36 allow for the operative gown to be adhered to the skin of the patient along the opening formed by removal of the removable shoulder portion or sleeve 32. The releasable adhesive tabs 36 help prevent the operative gown from interfering with the prep and drape site so as to facilitate sterility.

Figure 8:
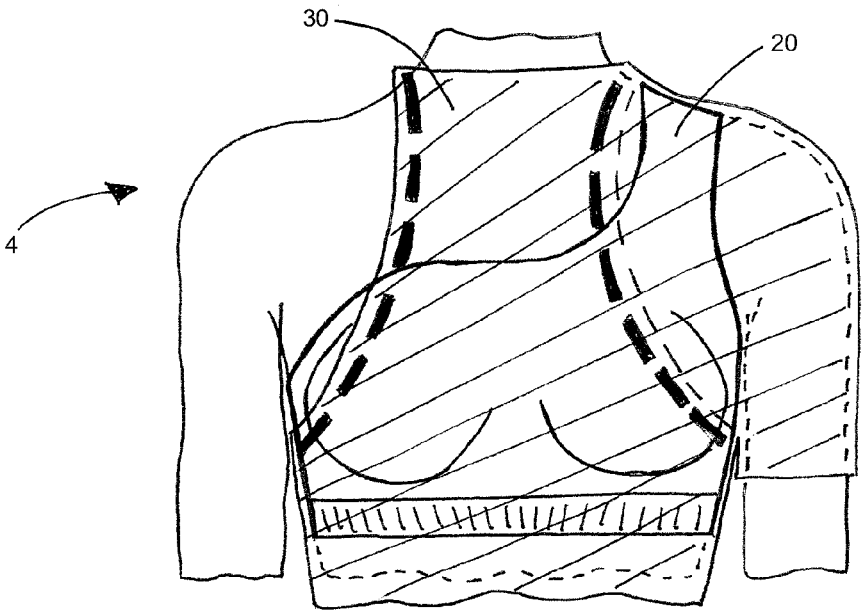
FIG. 8 is a frontal view illustrating one example of a surgical garment system including an undergarment and an outer garment with removal of a removable shoulder portion of the outer garment.

In one example of use, the outer garment 30 is worn in conjunction with the above-described undergarment 20 (see FIG. 8). For example, after the above-described undergarment 20 (i.e., surgical brassiere) is donned, the outer garment 30 (i.e., operative gown) is put on by the patient over the undergarment before surgery. The outer garment 30 may be put on by the patient, for example, in the holding area.

In one example, tearing through the perforations 34 to remove the removable shoulder portion or sleeve 32 of the operative gown to expose the skin of the operative shoulder 4 and applying the releasable adhesive tabs 36 to the skin to secure the operative gown to the patient is done in the holding area prior to surgery while the patient is awake. This allows for exposure of the skin to the surgeon for marking of the surgical site without exposing the breasts of the patient (FIGS. 5, 6, 7, 8). Exposing the shoulder in the holding area with the patient awake also provides the patient with a sense of control and piece of mind with regards to the extent of bodily exposure to be experienced throughout the procedure. In one example, the operative gown will cover the surgical brassiere, as worn beneath the operative gown, yet still allow enough exposure to facilitate adequate prep and drape of the shoulder during the procedure.

Further to the above, and with reference to the figures, FIG. 1 illustrates a front view of undergarment 20 (surgical brassiere) including thick elastic band 22 (lower riding on torso for more support), shoulder strap 24 (wide band for load distribution), and Velcro on the side, as indicated at 26, with operative shoulder 4 exposed. FIG. 2 illustrates a non-operative shoulder view of undergarment 20 including thick elastic band 22, wide shoulder strap 24, Velcro 26, and rip cord tab 28 to release the Velcro, with undergarment 20 being higher riding for more support, as indicated at 29. FIG. 3 is an operative shoulder view of undergarment 20 including thick elastic band 22. FIG. 4 is a front view of outer garment 30 (operative gown) including removable shoulder portions 32, perforations 34, and sticky tabs 36. FIG. 5 is a front view of outer garment 30 including perforations 34 (not used) and sticky tabs 36, with operative shoulder 4 exposed. FIG. 6 is a back view of outer garment 30 including perforations 34 (not used) and sticky tabs 36, with operative shoulder 4 exposed. FIG. 7 is an operative shoulder view of outer garment 30 including sticky tabs 36. FIG. 8 is a front view (gown over bra) of outer garment 30 (over undergarment 20) and undergarment 20 (under outer garment 30), with operative shoulder 4 exposed.

In one example, after the patient has donned the surgical brassiere and the operative gown, the patient is taken to the operating room and positioned for the shoulder surgery. The skin is prepped and the shoulder is draped. The surgery is performed, and the sterile dressing is then applied. Given the preparation solution and fluids that the operative gown may be exposed to during the surgery, the operative gown is removed after surgery. The patient, however, is still covered by the surgical brassiere (and, if desired, additional blankets). The patient then leaves the surgical center with the surgical brassiere in place and their breasts still covered. Once home, the patient may then remove the surgical brassiere in the privacy of their own home, thus undergoing the entire procedure without having to expose their breasts.

The disclosed surgical garment provides a patient with a two-piece system that could be utilized before, during, and after shoulder surgery. The system would assist in providing coverage for the patient while still facilitating marking of the surgical site, providing sterility during preparation and draping, and providing support of the breasts post-operatively without undue pressure from straps on the operative shoulder.

Although the invention herein has been described with reference to particular examples, it is to be understood that these examples are merely illustrative of the principles and applications of the present invention. It is therefore to be understood that numerous modifications may be made to the illustrative examples and that other arrangements may be devised without departing from the spirit and scope of the present invention as defined by the appended claims.

What is claimed is:

1. A surgical garment, comprising:

a torso portion;

removable shoulder portions extending from and removably connected to the torso portion, wherein the removable shoulder portions are delineated from the torso portion by perforations and are selectively removable from the torso portion along the perforations; and releasable adhesive tabs provided on the torso portion adjacent the perforations medially of the removable shoulder portions, wherein the releasable adhesive tabs allow adherence of the torso portion of the surgical garment to the wearer along an opening formed by removal of a respective removable shoulder portion.

2. The surgical garment of claim 1, wherein the surgical garment is configured to cover the body of the wearer from the neck to below the knees.

3. The surgical garment of claim 1, wherein the surgical garment is constructed of water repellent paper.

4. A surgical garment, comprising:

a torso portion;

removable shoulder portions removably connected to and extending from the torso portion, the torso portion of the surgical garment being releasably adherable to the wearer along an opening formed by removal of a respective removable shoulder portion, the removable shoulder portions being delineated from the torso portion by perforations and being selectively removable from the torso portion along the perforations; and releasable adhesive tabs provided adjacent the perforations medially of the removable shoulder portions for releasably adhering the torso portion of the surgical garment to the wearer along the opening formed by removal of a respective removable shoulder portion.

5. The surgical garment of claim 4, wherein the releasable adhesive tabs extend along a front of the torso portion and a back of the torso portion.

6. The surgical garment of claim 4, wherein the perforations extend continuously along and between a front of the torso portion and a back of the torso portion.

7. The surgical garment of claim 4, wherein the perforations extend laterally of a neck opening of the torso portion to a side of the torso portion.

8. The surgical garment of claim 4, wherein the perforations extend laterally of a neck opening of the torso portion to a side of the torso portion along and continuously between a front of the torso portion and a back of the torso portion.

9. The surgical garment of claim 4, wherein the opening formed by removal of a respective removable shoulder portion extends laterally of a neck opening of the torso portion to a side of the torso portion.

10. The surgical garment of claim 4, wherein the surgical garment is constructed of water repellent paper.

11. The surgical garment of claim 1, wherein the opening formed by removal of a respective removable shoulder portion extends laterally of a neck opening of the torso portion to a side of the torso portion.

12. The surgical garment of claim 1, wherein the releasable adhesive tabs extend along a front of the torso portion and a back of the torso portion.

13. The surgical garment of claim 1, wherein the perforations extend continuously along and between a front of the torso portion and a back of the torso portion.

14. The surgical garment of claim 1, wherein the perforations extend laterally of a neck opening of the torso portion to a side of the torso portion.

15. The surgical garment of claim 1, wherein the perforations extend laterally of a neck opening of the torso portion to a side of the torso portion along and continuously between a front of the torso portion and a back of the torso portion.

* * * * *